United States Patent [19]

Reyes, Jr.

[11] Patent Number: 4,591,163

[45] Date of Patent: May 27, 1986

[54] MARBLE TOSSING GAME

[76] Inventor: Tony Reyes, Jr., 4111 Holiday Pl., Oklahoma City, Okla. 73112

[21] Appl. No.: 645,167

[22] Filed: Aug. 28, 1984

[51] Int. Cl.[4] ..... A63F 7/02

[52] U.S. Cl. ..... 273/401; 273/1 G; 273/138 R

[58] Field of Search ..... 273/398–402, 273/342, 138 R, 126 R, 127 R, 353, 1 G

[56] References Cited

U.S. PATENT DOCUMENTS 3,818,628 6/1974 Ensmann et al. ..... 273/342 X

*Primary Examiner*—Paul E. Shapiro

*Attorney, Agent, or Firm*—Christopher H. Morgan

[57] ABSTRACT

A method of playing a game with a set of marbles and a pitching cup with a hemispherical receptacle for receiving tossed marbles. The game is played by distributing the marbles evenly among the players. A first player collects an equal number of marbles from each player as a tossing set and makes an odd or even toss prediction. The first player then tosses the marbles at the pitching cup. The number of marbles which remain in the cup after the toss is compared to the prediction. If correct in his odd or even prediction, the first player is given the tossing set and his turn continues with collecting a new tossing set, making a prediction, etc. An incorrect prediction results in the tossing set being given to an opponent who now becomes the tossing player. Play continues in this manner until one player wins all the marbles.

1 Claim, 2 Drawing Figures

MARBLE TOSSING GAME

BACKGROUND OF THE INVENTION

The present invention relates to a marble game and, in particular, a game wherein marbles are tossed or dropped into a cup.

SUMMARY OF THE INVENTION

The present invention comprises a method of playing a game for opposing players. The game is played with marbles of a selected diameter and a pitching hole comprising a block having a generally hemispherical depression therein. Each of the players is provided an equal plurality of marbles. The radius of the hemispherical depression in the block is greater than the total of the diameters of a number of marbles less than said plurality of said marbles.

An equal plurality of marbles from each player is collected and the marbles collected are placed in the hand of said first of said opposing players. For example, two marbles are collected from each of two players for a total of four marbles. The first player declares whether the number of marbles remaining in the pitching hole after a toss will be odd or even. The first player tosses the collected marbles into the pitching hole from a preselected height. The tossed marbles are allowed to come to rest and it is determined whether the number of marbles remaining in the pitching hole is odd or even or zero.

If the number of marbles is zero, the toss is repeated by the same player using the same marbles. If the number of marbles remaining in the pitching hole is the same as the number (odd or even) of marbles declared by the first player, all of the marbles tossed are given to that player. The first player then continues collecting an even plurality of marbles from each player declaring odd or even, and tossing the collected marbles until his declaration is incorrect. If the declaration of the first player is different (incorrect) from the number (odd or even) of marbles determined after the tossed marbles are allowed to come to rest, the marbles are given to a second opposing player. The second opposing player then becomes the tossing player and collects an equal plurality of marbles from each player. He then declares and tosses these marbles in the same manner as the first player. The play continues among the opposing players repeating the declaring, tossing, determining and giving steps until one player has all the marbles.

DESCRIPTION OF PREFERRED EMBODIMENT

The game of the present invention includes a pitching cup block and forty marbles. If desired, the game can be played with any number of marbles which are evenly divided between the players before the game begins.

Figure 1:
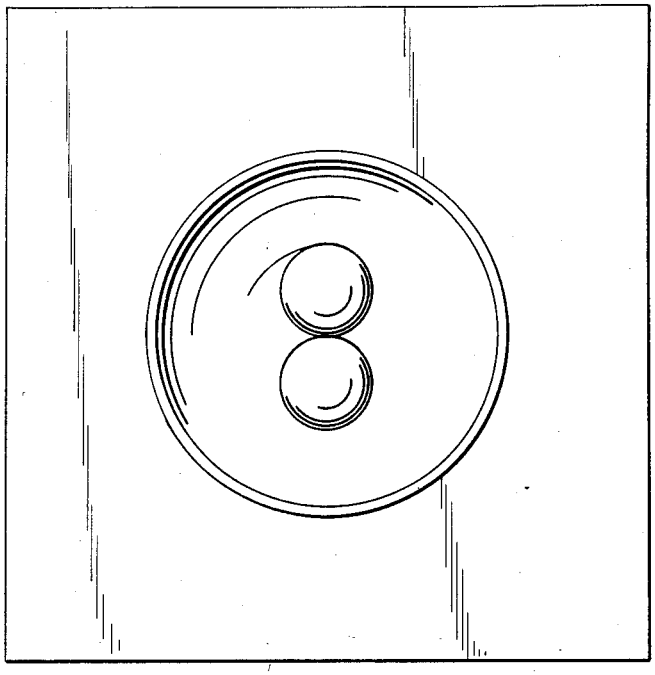
FIG. 1 is a plan view of the pitching cup of the present invention and two marbles.
Figure 2:
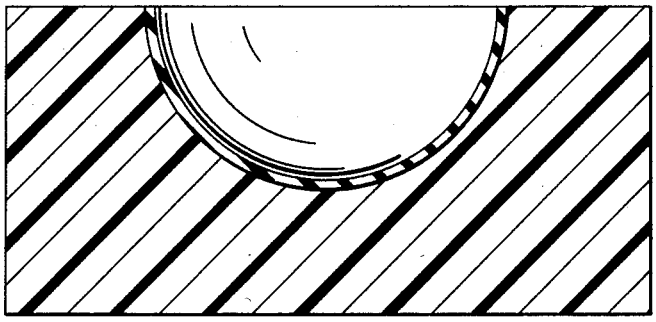
FIG. 2 is a side cross-sectional view of the pitching cup shown in FIG. 1, taken along the lines shown in FIG. 1.

Referring to FIG. 1, pitching cup block 11 includes a pitching cup 12 and a base 13. The pitching cup 12 is made of rubber or the like and has a hollow hemispherical shape. The cup 12 is disposed in a rectangular base 13 which can be made of styrofoam. The cup 11 faces upwardly so that marbles dropped, pitched or released from above can be received therein. The inside of the cup 12 has a diameter of two and a quarter inches. The base 13 is two inches tall and four and a quarter inches long on each of its sides 15, 17, 19 and 21. The marbles 23 and 25 are approximately 0.6 inches in diameter. The cup 12 can, of course, hold one, two, three, four or more marbles which are dropped into it.

To prepare for play the marbles are evenly divided among the players and the pitching cup is placed to receive tosses of the players. An agreed upon height above the pitching cup is selected as the pitching height. For example, two feet above the pitching cup can be selected as the pitching height.

To determine who will go first, one player calls odd or even and takes two marbles into his pitching hand. This player then, pitches, tosses, drops or releases the two marbles from his pitching hand into the pitching cup. The marbles are allowed to come to rest and if the marbles remaining in the pitching cup are the same as the pitching players call (odd or even), then this player begins the game. If the call was incorrect, then one of this player's opponents begins the game.

The first player who begins the game places two of his marbles along with two marbles from each of his opponents in his pitching hand. Before making a toss, the first player announces his selection of odd or even. The first player then releases the marbles from his pitching hand at the agreed upon pitching height. After the marbles come to rest, the number of marbles remaining in the cup is compared with the first player's announced odd or even prediction. If the first player's prediction of odd or even is correct, he wins the marbles. If his prediction is incorrect, then his opponent wins the marbles. If no marbles land in the pitching cup, the first player repeats his toss.

If the first player's prediction is correct, then the first player continues tossing. From each toss, two marbles are collected from each opponent. If the first player is incorrect in his prediction, his opponent becomes the tossing player and collects and tosses marbles in the manner described above. The player who wins all of his opponents marbles wins the game.

Although the game was described with the players collecting two marbles from each of his opponents, the players can pitch as many marbles as agreed upon by the players.

I claim:

1. A method of playing a game for opposing players comprising the steps of:

(a) providing an equal plurality of marbles of a selected diameter for each of said players; p1 (b) providing a pitching hole comprising a block having a generally hemispherical depression with a radius greater than the total of the diameters of a number of marbles less than said plurality of said marbles;

(c) collecting an equal plurality of marbles from each player and placing all said marbles collected in the hand of a first of said opposing player;

(d) declaring by said first player whether the number of marbles remaining in said pitching hole will be odd or even;

(e) said first player tossing said collected marbles into said pitching hole from a preselected distance;

(f) allowing said tossed marbles to come to rest;

(g) determining whether the number of marbles remaining in said pitching hole is odd or even or zero; p1 (h) if the number of marbles remaining is zero, repeating steps d through g with the marbles collected in step c;

(i) if the declaration of said first player is the same as the number (odd or even) of marbles determined in step g, giving all the marbles collected in step c to that player and repeating steps c through i;

(j) if the declaration of said first player is different from said number (odd or even) of marbles determined in step g giving the marbles to a second, opposing, player and repeating steps c through j by said second player; and (k) repeating steps c through j until one player has all the marbles.

* * * * *